US008424873B2

(12) United States Patent
Storey et al.

(10) Patent No.: US 8,424,873 B2
(45) Date of Patent: Apr. 23, 2013

(54) MAGNETIC COUPLED INTERMEDIATE IDLER

(75) Inventors: Matthew M Storey, Rochester, NY (US); Adam D Ledgerwood, Geneva, NY (US); Aaron M Moore, Fairport, NY (US); Derek A Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 272 days.

(21) Appl. No.: 13/080,691

(22) Filed: Apr. 6, 2011

(65) Prior Publication Data

US 2012/0256369 A1 Oct. 11, 2012

(51) Int. Cl.
*B65H 5/02* (2006.01)

(52) U.S. Cl.
USPC ..... 271/272; 271/901

(58) Field of Classification Search ..... 271/264, 271/272, 901
See application file for complete search history.

(56) References Cited

U.S. PATENT DOCUMENTS

| | | | | |
|---|---|---|---|---|
| 3,907,275 | A * | 9/1975 | Bossons | 271/69 |
| 6,811,152 | B2 | 11/2004 | Delfosse et al. | |
| 6,877,743 | B2 * | 4/2005 | Van Den Berg et al. | 271/273 |
| 7,416,183 | B2 * | 8/2008 | Beckstrom et al. | 271/250 |
| 2011/0262200 | A1 * | 10/2011 | Shiba | 399/396 |

* cited by examiner

*Primary Examiner* — Michael McCullough
*Assistant Examiner* — Howard Sanders

(57) ABSTRACT

An improved rotator/translator apparatus includes a set of drive rolls driven by a pair of rotator discs. Idler rolls are positioned above each drive roll and spring loaded to provide the required normal force to drive sheets in any direction required. A pair of magnetic couplings couple the drive rolls with the idler rolls. The magnetic couplings are spaced with about a 5 mm gap to allow sheets to pass therethrough. The couplings allow the idlers and the drive rolls to stay aligned. Thus, driving media, registering media and rotating media in a transport is obtained, but with no relative motion or slip between the drive rolls/idler rolls and the media and a larger nip surface area, thereby eliminating marking of certain media.

20 Claims, 3 Drawing Sheets

MAGNETIC COUPLED INTERMEDIATE IDLER

CROSS-REFERENCE

Cross-reference is hereby made to commonly assigned and copending U.S. application Ser. No. 13/030,503, filed Feb. 18, 2011, and entitled "MEDIA ROTATION AND TRANSLATION MECHANISM" by Derek Albert Bryl, et al. and application Ser. No. 13/030,514, filed Feb. 18, 2011, and entitled "MEDIA ROTATION AND TRANSLATION APPARATUS" by Matthew M. Storey, et al. The disclosures of the heretofore-mentioned applications are incorporated herein by reference in their entirety.

BACKGROUND

1. Field of the Disclosure

The present disclosure relates broadly to a finisher transport module system, and more particularly, to an improved rotator and translator apparatus employing a magnetic coupled intermediate idler used in controlling the orientation and alignment of media passing through a finisher transport module.

2. Description of Related Art

Finishing transport module systems for rotating and translating sheets passing through the system are known, for example, U.S. Pat. No. 6,811,152 which is incorporated herein by reference along with the references cited therein. Another example is shown in prior art FIG. 1, where a sheet rotator and translator mechanism for a finishing transport module 10 includes two rotator disc motors 30 and 30 that drive each rotator disc 12 and 14 independently. When turning in the same direction and at the same speed, a sheet will pass through the rotator device like any normal nip set (no rotation or directional offset). With the motors still rotating in the same direction and speed, steering idlers 16 and 18 can be rotated around the periphery of the discs to alter the inboard/outboard position of a sheet without rotation. This is useful for offsetting sheet sets in a stacker or for changing center and edge registration for finishing devices located downstream. To know when the sheet has been offset the desired amount, there is an edge sensor 40 that is positionable by a lead screw. A motor 33 connected to the lead screw positions the sensor 40 a set distance inboard/outboard for one sheet set, then repositions the sensor to detect the inboard/outboard position for the next sheet set. For sheet rotation, the motors controlling the rotator discs simply spin at different velocities. The larger the velocity differential, the faster the media is rotated.

The term 'sheet' herein refers to any flimsy physical sheet or paper, plastic, or other useable physical substrate for printing images thereon, whether precut or initially web fed.

A problem with this design is that the discs spin horizontally while the idlers spin vertically. To prevent excessive relative motion (in the cross process direction) each disc has a sharp lip for a contact point with the idler. The high pressure nip is shown in prior art FIG. 1 and includes a very small contact point 13 between the disc 12 and the idler 18, as well as, a sharp contact point 15 between disc 14 and idler 16. This effectively removes the relative motion since there is essentially only one radius, but the pressure is very high. This high pressure is necessary to prevent slip, but ultimately does cause marking on certain media, especially coated sheets.

Thus, there is still a need for a solution to the excessive relative motion problem of existing finishing transport module systems that would eliminate marking of certain types of media.

BRIEF SUMMARY OF THE DISCLOSURE

Accordingly, in answer to the above-mentioned problem and disclosed herein is an improved rotator/translator apparatus that includes a set of drive rolls driven by a pair of rotator discs. Idler rolls are positioned above each drive roll and spring loaded to provide the required normal force to drive sheets in any direction required. A pair of magnetic couplings couple the drive rolls with the idler rolls. The magnetic couplings are spaced with about a 5 mm gap to allow sheets to pass therethrough. The couplings allow the idlers and the drive rolls to stay aligned. Thus, driving media, registering media and rotating media in a transport is obtained, but with no relative motion or slip between the drive rolls/idler rolls and the media and a larger nip surface area, thereby eliminating marking of certain media.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
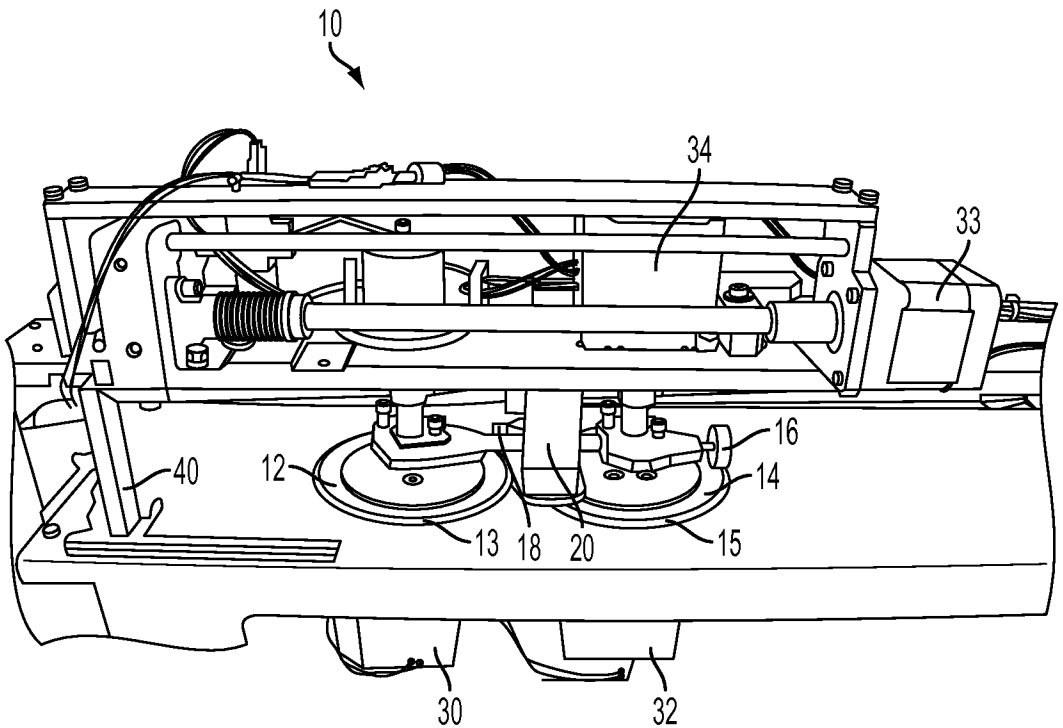
FIG. 1 PRIOR ART
FIG. 1 is a partial frontal view of a prior art sheet rotator/translator mechanism for use in a finisher transport module.
Figure 2:
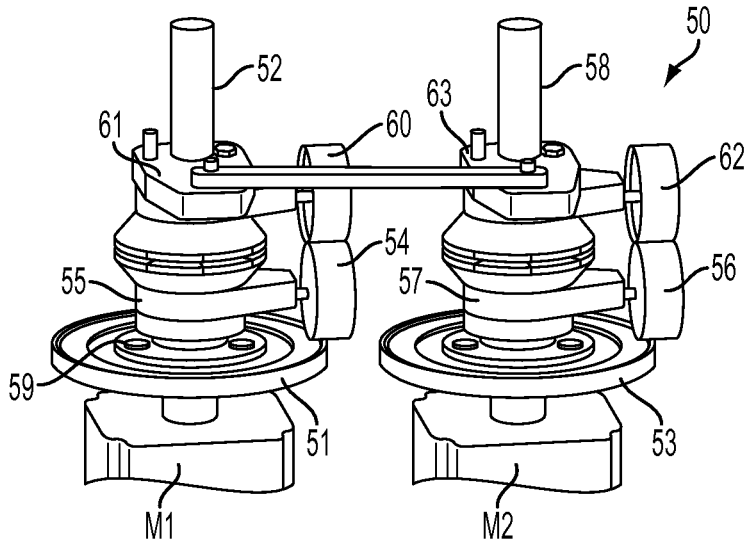
FIG. 2 is a partial perspective view of an improved sheet rotator/translator mechanism in accordance with the present disclosure.

Turning now to the drawings wherein the showings are for the purpose of illustrating an exemplary embodiment and not intended as a limitation, FIG. 2 illustrates a partial perspective view of an improved sheet rotator/translator mechanism in accordance with the present disclosure for accomplishing the sheet registration, rotation and translation in a finisher transport module system without sheet marking.

A number of existing finishing transport module systems employ a media rotation and translation mechanism that utilizes two disc/idler pairs for re-registering conveyed sheets from center to side registration. However, the nip width between the disc and idler is thin relative to the diameter of the disk to avoid slippage, but the resulting high nip pressure has caused marking on coated sheets. In accordance with the present disclosure, the disc and flat idler nip combination employed heretofore to manipulate sheets in feeder transport modules has been replaced with a pair of discs for driving a pair of drive rolls that mate with a pair of idler rolls with a magnetic coupling positioned between the drive rolls and idler rolls to permit sheets to be conveyed therethrough.

Figure 3:
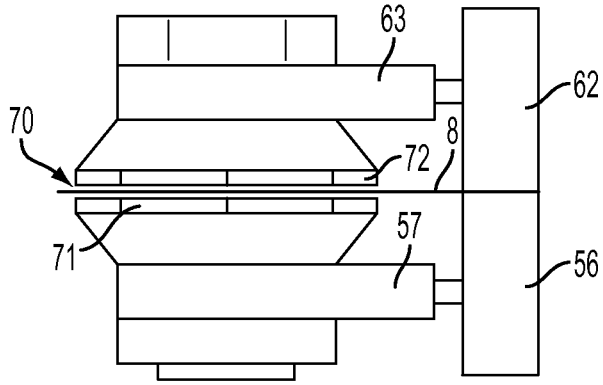
FIG. 3 is a partial frontal view showing a sheet passing through a magnetic coupling/drive roll/idler roll arrangement of the improved sheet rotator/translator mechanism shown in FIG. 2.
Figure 4:
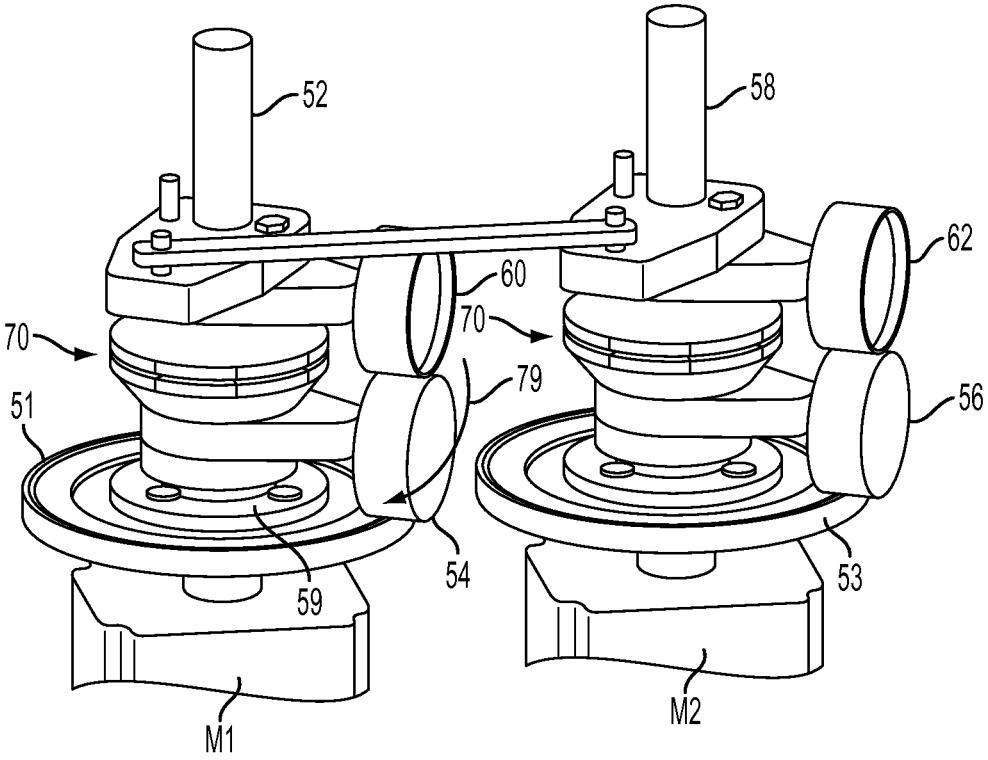
FIG. 4 is a partial perspective view of the improved sheet rotator/translator mechanism in accordance with the present disclosure showing the magnetic coupling/drive roll/idler roll arrangement of FIG. 2 having been rotated a predetermined amount about the periphery of horizontally rotating discs.

As shown in FIGS. 2-4, a sheet rotator/translator mechanism 50 eliminates the relative motion between a sheet and a drive member, as well as, the need for a high pressure contact nip between the sheet and the drive member by including rotator discs 51 and 53 that rotate in a horizontal plane and are driven by motors M1 and M2, respectively. Two cylindrical intermediate rolls 54 and 56 form nips with and are driven by the opposing rotator discs 51 and 53. Intermediate rolls 54 and 56 are mounted on spring loaded cantilevered arms 55 and 57 that are supported for rotational movement about and independently of shafts 52 and 58. Idlers 60 and 62 are positioned above each intermediate roll to provide the required normal force to drive sheets conveyed therebetween in any direction. Intermediate idlers 54 and 56 are driven through contact pressure with the powered discs 51 and 53 below them, but allow for traditional cylinder-on-cylinder nip contact with idlers 60 and 62, respectively, to drive sheets. The dual idler rolls are used to separate high pressure contact for the drive force from the contact force on the sheets.

More specifically, and as seen in FIG. 3, intermediate idler 54 is connected through arm 63 to shaft 58 that is driven by motor M2, but allowed to rotate independently. That is, support member 59 is connected to disc 51 and rotates with it, but cantilevered arm 55 remains stationary until the top idler 60 is rotated. In this way, it is free to remain paired with idler 60 above it. This will be accomplished through the use of two permanent disc magnets 70 (one of which is shown in FIG. 3), separated only enough to allow sheets to pass therebetween. The magnetic couplings facilitate the movable nip connections. The two opposing poles of the disc magnets are shown as 71 and 72. The attractive force between the two rotationally offset magnets will require a torque to overcome. This holding torque will be able to hold the two roller pairs in an otherwise unstable, vertical position. It will also allow the roller pairs to move together when the entire roller nip pair is rotated for paper registration as shown in FIG. 4.

A suitable permanent magnet 70 is marketed by Magnetic Technologies LTD, and more specifically, their MTD-0.6 magnetic coupler. The magnetic coupler 70 leaves a 0.19 inch (5 mm) gap for sheets to pass therethrough. It has a torque peak of 8 lb-in, which would give a 3.5 lb stabilizing/following force to the Intermediate Idlers 54 and 56. Magnetic coupling 70 allows the sheets to be transported by the two parallel, cylindrical idlers 54, 56 with no relative motion, for more reliable transport, and therefore, allow for a lower pressure nip that eliminates paper marking.

It should now be understood that an improved rotator/translator mechanism has been disclosed for use in a finishing transport module system that eliminates relative motion between the drive rolls/idler rolls nip and the need for a high pressure contact nip by using an intermediate roller that is kept paired with the an idler above by two disk magnets. These magnets will couple the top and intermediate idlers such that any change in the position of the top idler will equally change the position of the intermediate idler and maintain nip contact. This "aligning force" is accomplished without a physical connection that would otherwise interfere with or cross into the paper path. The intermediate idler eliminates the relative motion at the paper nip and negates the need for a sharp contact point that causes paper marking.

Alternatively, the disclosed rotator/translator mechanism could be used in any registration system were motion is desired in multiple directions. The magnetic coupling allows a driving force to be applied in a variable yet controllable direction.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A finisher transport module includes an improved feeder, rotator and translator mechanism for use in controlling the orientation and alignment of media passing through said finisher transport module, comprising:

a pair of closely spaced rotating discs;

a pair of idler rolls positioned above said rotating discs;

a pair of intermediate idler rolls positioned between said rotating discs and said pair of idler rolls and forming nips with said idler roll pair for said media to pass therethrough, and wherein said rotating discs provide a driving force to said intermediate idler roll pair which in turn provides a driving force to said idler roll pair; and magnetic couplings adapted to mate said idler roll pair with said intermediate idler roll pair while simultaneously providing an opening therethrough which said media passes when conveyed through said finishing transport module.

2. The mechanism of claim 1, wherein said magnetic couplings are spaced with a gap of approximately 5 mm.

3. The mechanism of claim 2, wherein said idler and intermediate roll nips are moved in unison.

4. The mechanism of claim 3, wherein said magnetic couplings prevent relative motion between said idler roll and intermediate roll nips and said media.

5. The mechanism of claim 4, wherein said magnetic couplings allow said idler and intermediate rolls to stay aligned.

6. The mechanism of claim 5, wherein said idler roll pair and said intermediate roll pair are cantilever mounted.

7. The mechanism of claim 6, wherein said rotating discs are driven by separate motors.

8. A device for manipulating sheets conveyed is a horizontal plane, comprising;

a pair of closely spaced rotating discs;

a first pair of idler rolls positioned above said rotating discs;

a second pair of idler rolls positioned between said pair of rotating discs and said first pair of idler rolls and forming nips with said first pair of idler rolls through which said media is conveyed, and wherein said pair of rotating discs provide a driving force to said second idler roll pair which in turn provides a driving force to said first idler roll pair; and magnetic couplings adapted to mate said first idler roll pair with said second idler roll pair while simultaneously providing an opening therethrough which said media passes when conveyed through said finishing transport module.

9. The device of claim 8, wherein said magnetic couplings include magnetic discs with a gap of approximately 5 mm therebetween.

10. The device of claim 8, wherein said first and second idler roll nips are moved in unison.

11. The device of claim 8, wherein said magnetic couplings prevent relative motion between said first idler roll and second idler roll nips and said media.

12. The device of claim 8, wherein said magnetic couplings allow said first idler and second idler rolls to stay aligned.

13. The device of claim 8, wherein said first roll pair and said second roll pair are cantilever mounted.

14. The device of claim 8, wherein said rotating discs are driven by separate motors.

15. The method of claim 8, wherein said first and second idler roll nips are moved in unison.

16. The method of claim 8, wherein said magnetic couplings prevent relative motion between said first idler roll and second idler roll nips and said media.

17. The method of claim 8, wherein said magnetic couplings allow said first idler and second idler rolls to stay aligned.

18. The method of claim 8, wherein said first roll pair and said second roll pair are cantilever mounted.

19. A method for controlling the orientation and alignment of media passing through a finisher transport module, comprising:

providing a pair of closely spaced rotating discs;

providing a first pair of idler rolls positioned above said rotating discs;

providing a second pair of idler rolls positioned between said pair of rotating discs and said first pair of idler rolls and forming nips with said first pair of idler rolls through which said media is conveyed, and wherein said pair of rotating discs provide a driving force to said second idler roll pair which in turn provides a driving force to said first idler roll pair; and providing magnetic couplings adapted to mate said first idler roll pair with said second idler roll pair while simultaneously providing an opening therethrough which said media passes when conveyed through said finishing transport module.

20. The method of claim 19, wherein said magnetic couplings include magnetic discs with a gap of approximately 5 mm therebetween.

* * * * *